US006276292B1

(12) United States Patent
Soulek

(10) Patent No.: US 6,276,292 B1
(45) Date of Patent: Aug. 21, 2001

(54) FOULANT CONTROL SYSTEM SUCH AS FOR USE WITH LARGE SHIPS

(76) Inventor: Alice B. Soulek, 120 State St. NE., #1180, Olympia, WA (US) 98501

( * ) Notice: Subject to any disclaimer, the term of this patent is extended or adjusted under 35 U.S.C. 154(b) by 0 days.

(21) Appl. No.: 09/191,561

(22) Filed: Nov. 13, 1998

Related U.S. Application Data

(60) Provisional application No. 60/066,019, filed on Nov. 14, 1997.

(51) Int. Cl.[7] ..... B63B 59/08
(52) U.S. Cl. ..... 114/222
(58) Field of Search ..... 114/222; 134/1

(56) References Cited

U.S. PATENT DOCUMENTS

| | | | | |
|---|---|---|---|---|
| 3,505,758 | | 4/1970 | Willisford | 43/131 |
| 3,570,256 | | 3/1971 | Thompson | 61/48 |
| 3,581,505 | | 6/1971 | Liddell | 61/46 |
| 3,685,477 | | 8/1972 | Wood | 114/222 |
| 3,961,594 | * | 6/1976 | Meyers | 114/222 |
| 4,026,233 | | 5/1977 | Cox | 114/229 |
| 4,046,094 | | 9/1977 | Preiser et al. | 114/222 |
| 4,058,075 | | 11/1977 | Piper, Sr. | 114/222 |
| 4,215,644 | | 8/1980 | Jackson | 114/222 |
| 4,244,749 | | 1/1981 | Sachs et al. | 134/1 |
| 4,280,436 | | 7/1981 | Jackson | 114/222 |
| 4,280,437 | | 7/1981 | Jackson | 114/222 |
| 4,280,438 | | 7/1981 | Jackson | 114/222 |
| 4,280,439 | | 7/1981 | Jackson | 114/222 |
| 4,282,822 | | 8/1981 | Jackson | 114/222 |
| 4,289,423 | | 9/1981 | Mougin | 405/61 |
| 4,444,146 | | 4/1984 | DeWitz et al. | 114/222 |
| 4,693,200 | | 9/1987 | Noble | 114/47 |
| 4,890,567 | | 1/1990 | Caduff | 114/222 |
| 4,943,954 | | 7/1990 | Ostlie | 367/191 |
| 4,998,496 | | 3/1991 | Shaw, III | 114/222 |
| 5,138,963 | | 8/1992 | Eichert | 114/222 |
| 5,143,011 | | 9/1992 | Rabbette | 114/222 |
| 5,152,242 | | 10/1992 | Bradley | 114/222 |
| 5,279,244 | | 1/1994 | Perez-Collazo | 114/222 |
| 5,465,676 | | 11/1995 | Falcaro | 114/222 |
| 5,651,326 | | 7/1997 | Rice | 114/45 |
| 5,735,226 | | 4/1998 | McNeal | 114/222 |

FOREIGN PATENT DOCUMENTS

| | | | | |
|---|---|---|---|---|
| 2 313 876 | * | 10/1973 | (DE) | 114/222 |
| 887355 | * | 12/1981 | (SU) | 114/222 |

* cited by examiner

*Primary Examiner*—Sherman Basinger
(74) *Attorney, Agent, or Firm*—Seed IP Law Group PLLC

(57) ABSTRACT

A method and apparatus for controlling foulant organisms on the hull of a resting ship that employs an enclosure material to enclose the ship's hull. Separation devices are attached in a grid pattern to the interior surface of the enclosure material to maintain a uniform distance between the material and the ship's hull. A thin, semi-absorbent, slightly tacky liner material is fit over the separation devices to catch foulant that falls from the hull of the ship. Cavitation produced by pulsating, ultrasonic sound waves emitted by transducers mounted beneath the waterline on the interior of the ship removes the foulant. Alternatively, the transducers are placed in watertight housings and mounted on the separation devices. In another embodiment of the invention, the enclosure material remains in place until the ship is ready to leave port. In yet another embodiment of the invention, the enclosure material is deployed and removed using winches and attached cargo ropes. In yet another embodiment of the invention the enclosure material includes inflatable triangular air pockets at the top of the enclosure material. In yet another embodiment of the invention, the enclosure material is stored on the ship in storage racks, rolled into place, and deployed using roller assemblies. In yet another embodiment of the invention, the enclosure is deployed in two or more pieces, and the seam between pieces is sealed using electromagnets.

46 Claims, 14 Drawing Sheets

POWER CALCULATIONS:

| | |
|---|---|
| Maximum Power Requirements Per circuit Board | 500 Watts |
| No. of Circuit Boards Required for 400 ft (121.92 m) Long Ship | 40 |
| | 20,000 Watts |

AVAILABLE POWER COMPARISON:

| | |
|---|---|
| US Frigate 390ft (118.9m) Long | 35,000 shp (shaft horse power) |
| Steam Turbine (Polmar, 1981) Conversion Factor to Watts | 746 |
| | 26,110 kW (Shaft Wattage) |

ENERGY REQUIREMENTS (kwH):

| | |
|---|---|
| Power for Cleaning System | 20,000 Watts |
| Time (30 minutes) | .5 |
| | 10kWh |
| Energy Cost per Cleaning @ $0.08/kWh | $0.80 |

PRELIMINARY STRESS ANALYSIS CALCULATIONS FOR TRACKING SYSTEM:

Buoyant Force on Envelope Material: $F_B$ = Buoyant Force acting on the Material, $\gamma$ = Specific Weight of the Water, $\forall$ = Volume of the Body $F_B = \gamma \forall$ (Munson, et al., 1994)

Where $\gamma$ = 69.054 lb./ft$^2$ for seawater + envelope material; $\forall$ = 676.6 ft$^3$ for 33,830 ft$^2$ of wetted surface area at 0.02 ft thick $F_B$ = (69.054 lb/ft$^3$) (676.6 ft$^3$) = 46,721.9 lb

| | |
|---|---|
| Distance between roller assemblies when material fully extended | 4 ft |
| Approximate Maximum wetted Surface Area for 4 ft Strip from Waterline to Center Line of Bottom of Hull for 400 ft Long Ship | 160 ft$^2$ |
| $F_B$ at 46,721.9 lb/33,830 ft$^2$ | 1.38 lb/ft$^2$ |
| $F_B$ for selected Wetted Surface Area | 220.8 lbs |
| Square Inches Supported Between Roller Assemblies (48 in. * 6 in.) | 288 in$^2$ |
| $F_B$ Divided by Square Inches | 0.77 psi |

*Fig. 13 (1/2)*

MATERIAL PROPERTIES FOR 6061-T6@75°F (MARKS, 1967):

| | |
|---|---|
| Tensile Strength | 45,000 psi |
| Yield Strength | 40,000 psi |
| Elongation (0.2 percent offset) | 17 psi |

MATERIAL PROPERTIES FOR UHMW@73°F (SOLIDUR):

| | |
|---|---|
| Tensile Strength | 6600 psi |
| Yield Strength | 3330 psi |
| Elongation @ Break | 350 psi |

STAINLESS STEEL (AISI TYPE 202) @ ROOM TEMP. (MCGANNON, 1971):

| | |
|---|---|
| Tensile Strength | 115,000 psi |
| Yield Strength | 55,000 psi |
| Elongation (0.2 percent offset) | 55 psi |

POLYETHYLENE (LOW DENSITY) (PARRISH, 1973):

| | |
|---|---|
| Tensile Strength | 2175 psi |
| Yield Strength | No Break |
| Elongation @ Break | 100-800% |

*Fig. 13 (2/2)*

FOULANT CONTROL SYSTEM SUCH AS FOR USE WITH LARGE SHIPS

This application claims benefit of Provisional Appln. 60/066,019 filed Nov. 14, 1997.

TECHNICAL FIELD

The present invention relates to methods and devices for controlling foulant organisms on the hull of a ship while the ship is at rest.

BACKGROUND OF THE INVENTION

Throughout history, efforts have been made to control fouling organisms that attach to ships. These efforts have met with varying degrees of success.

Prolonged and untreated fouling results in a degradation in the engineering properties of the ship's components and can lead to eventual destruction of the ship's structure. The plants and animals that constitute foulant material generally occur naturally in shallow waters along coastlines throughout the world. There are approximately 2,000 species of fouling organisms. The dominant type of fouling organism varies with location, air and water temperature, and time of year. Control of these organisms needs to occur before attachment to the surface of the ship, and an effective method of removal of any organisms that do attach is also critical.

Most of the efforts to control fouling in recent years have concentrated on the development of coatings for ships' hulls. Progress has been made in the development of these coatings. However, due to the sheer numbers, variety and complexity of marine organisms, finding one coating that can be effective under all conditions is extremely difficult.

Currently, the most common method of removing foulant once the organisms attach requires the boat to first be dry docked. Once in dry dock, a cavitating jet fouling removal device is used, which consists of high pressure water pumped through nozzles mounted on a carriage that moves along the side of the hull of the ship.

A search has revealed the following potentially relevant issued patents:

U.S. Pat. No. 3,505,758; U.S. Pat. No. 3,570,256; U.S. Pat. No. 3,581,505; U.S. Pat. No. 3,685,477; U.S. Pat. No. 4,026,233; U.S. Pat. No. 4,046,094; U.S. Pat. No. 4,058,075; U.S. Pat. No. 4,215,644; U.S. Pat. No. 4,244,749; U.S. Pat. No. 4,280,436; U.S. Pat. No. 4,280,437; U.S. Pat. No. 4,280,438; U.S. Pat. No. 4,280,439; U.S. Pat. No. 4,282,822; U.S. Pat. No. 4,289,423; U.S. Pat. No. 4,444,146; U.S. Pat. No. 4,693,200; U.S. Pat. No. 4,890,567; U.S. Pat. No. 4,943,954; U.S. Pat. No. 4,998,496; U.S. Pat. No. 5,138,963; U.S. Pat. No. 5,143,011; U.S. Pat. No. 5,152,242; U.S. Pat. No. 5,279,244; U.S. Pat. No. 5,465,676; U.S. Pat. No. 5,651,326; and U.S. Pat. No. 5,735,226.

SUMMARY OF THE INVENTION

The present invention addresses the age old problem of marine fouling and overcomes disadvantages associated with the prior art while providing additional benefits. An exemplary embodiment combines an enclosure of a hull of a ship at rest with the use of ultrasonic transducers. The enclosure material may be a waterproof tarp-like material. The transducers may be mounted on circuit boards placed in a diamond-shaped grid on the interior of the ship's hull. Alternating spacers may be used between the hull of the ship and the enclosure material to maintain a uniform distance.

The transducers may be placed on these spacers. Once the hull is enclosed, the transducers induce cavitation between the enclosure material and the hull of the ship which results in the removal of the foulant organisms from the hull of the ship.

Another exemplary embodiment of the present invention includes a deployment system consisting of a storage cart, a deployment track mounted to a railing of a ship and a roller assembly to facilitate deployment of the enclosure. The storage cart is wheeled to the deck railing and secured for deployment. The enclosure material is laid, accordion-style, on the storage rack when stored. The enclosure material is attached to roller assemblies inside the track system and deployed.

Yet another exemplary embodiment of the present invention includes a connecting link at midship for enclosure material that is deployed in two or more pieces from either end of a ship. In accordance with this embodiment, electromagnets are placed at evenly spaced intervals in a strip of UHMW (ultra-high-molecular weight) material along a leading edge of the enclosure. An electromagnetic current is then used to draw the two pieces together.

The present invention provides a dual advantage over the prior art by both preventing the organisms from reaching the coating on a ship's hull and by cleaning, through cavitation, any organisms that have previously become attached. This is contrary to the current approach of either waiting to control the organisms during attachment at the point of contact with a coating on the hull, or placing the ship in dry dock and cleaning the organisms after attachment.

The present invention simultaneously addresses multiple factors that inhibit or prevent the growth of marine organisms. These include temperature, salinity level, water velocity, light level and cleaning by cavitation.

Marine organisms exist within very narrow bands of tolerance for changes in such properties as temperature and salinity level. Temperatures approaching 212° F. (100° C.) and salinity levels lower than 3 ppt are conditions that have been shown to prevent or control fouling. By eliminating or reducing the amount of visible light, many marine organisms are unable to grow or reproduce. In addition, linear velocities in excess of 1.3 knots prevent the attachment of many kinds of organisms. Almost all fouling occurs at low speeds or when the ship is at rest. What appears to be fouling at sea really begins in port.

This invention takes advantage of the biological weaknesses of the organisms by raising the temperature of the water between the enclosure material and the hull beyond the tolerance level of the organisms. This rise in temperature also effectively lowers the salinity level below that needed for marine growth. In addition, the velocity of the water during cavitation is too high for attachment of organisms. Finally, the enclosure material cuts off the light needed by many organisms to grow.

The present invention provides a unique approach to a complex problem. Used in combination with an anti-fouling coating, this invention can control fouling where and when it occurs. These and other aspects of the present invention will become evident upon reference to the following detailed description and attached drawings. It is to be understood that various changes, alterations, and substitutions may be made to the teachings contained herein without departing form the spirit and scope of the present invention. It is to be further understood that the drawings are illustrative and symbolic of exemplary embodiments of the present invention.

BRIEF DESCRIPTION OF THE DRAWINGS

FIG. 13 is sample engineering calculations.

DETAILED DESCRIPTION OF THE INVENTION

Many specific details of certain embodiments of the invention are set forth in the following description, and in FIGS. 1–13, to provide a thorough understanding of such embodiments. One skilled in the art, however, will understand that the present invention may have additional embodiments, or that the invention may be practiced without several of the details described in the following description.

Figure 1:
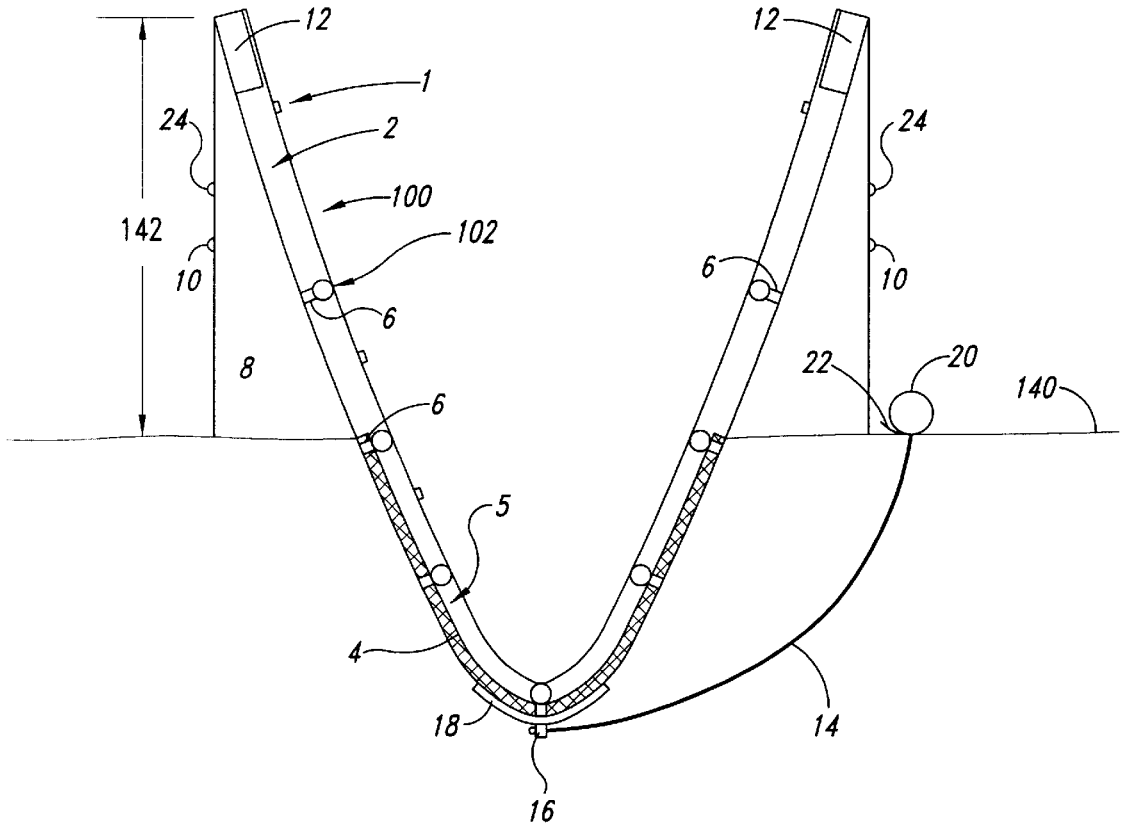
FIG. 1 is a schematic cross-sectional view at the bow of the ship of a fully deployed enclosure material (taken from line A—A in FIG. 5).

Referring to FIG. 1, the invention is directed toward the methods and apparatuses for removing and controlling foulant organisms on a hull 102 of a ship 100 while the ship 100 is at rest. One exemplary embodiment of the invention includes an enclosure of waterproof enclosure material 2 which forms an envelope that is slightly larger than the shape and size of the hull 102 of a ship 100 and interior hull-mounted transducers 1 which emit ultrasonic sound waves that induces cavitation.

The enclosure material 2 is designed and assembled based on specifications for the appropriate class of ships. The enclosure material 2 should be light weight, durable, waterproof, resistant to chemical attack by prolonged exposure to sea water and temperatures at the boiling point of water, readily available, easy to maintain, and low in cost. All of these factors are important because of the amount of material needed. A standard polyethylene, cross-woven type is one example of the type of material that could be utilized for this purpose. As an example of the quantity of material required, the wetted surface area of a ship 400 ft (121.92 m)×54 ft (16.46 m)×26 ft (7.92 m) draft and 12,000 tons (10,886 kg) displacement is 33,830 $ft^2$ or 3,759 $yd^2$ (3,143 $m^2$) using the known Mumford formula.

FIG. 1 is a schematic cross-sectional view of the fully deployed enclosure material 2 and additional components at the bow of the ship 100. As best seen in FIG. 1, located inside the deployed enclosure material 2 is a thin, semi-absorbent lining material 4 with a slightly tacky surface that is held in place by Velcro® strips (not shown) and by cross cuts (not shown) that permit the material to fit over caster-like separation devices 6.

As an example calculation of the total weight of enclosure material 2 below the waterline 140, for a ship 100 that is 400 ft×54 ft×26 ft with a wetted surface area of 3,759 $yd^2$ the weight was calculated at approximately 778 lbs. (352.90 kg), or 389 lbs. (176.45 kg) for each half of the ship 100. An additional 500 lbs. (226.80 kg) of enclosure material 2 would be necessary to cover the area around the ship 100 from the waterline 140 to the deck 104 of the ship 100. Standard polyethylene enclosure material 2 of the cross-woven type is readily available virtually anywhere, easily repaired and highly resistant to the corrosive effects of sea water.

In accordance with one exemplary embodiment of the invention, the chosen enclosure material 2 also may be lined with a reflective material 5 similar to the "space blankets" used on camping trips. This reflective material 5 helps to retain the heat produced by cavitation and, because it is metallic, may provide a reflective surface for the ultrasonic sound wave emanating from inside the hull 102 of the ship 100. This reflective material 5 should be laid on top of the enclosure material 2 and secured at the seams when the seams of the enclosure material 2 are joined and waterproofed. For the ship discussed above, this is expected to add another 500 lbs. (226.80 kg) in weight to the enclosure material 2 with a total thickness of ⅛ in. (0.03 cm). The reflective material 5 should be large enough to extend above the highest expected waterline 140.

In accordance with one embodiment of the invention, mounted to the outside of the enclosure material 2 are inflatable buoys 20 which are attached at evenly spaced intervals below the high waterline 140. These buoys 20 provide buoyancy and support for the enclosure material 2.

In accordance with one embodiment of the invention, the upper portion of the enclosure material 2 is further composed of a right angle triangular pocket 8 that extends from the hull's low water mark to a distance 142 above the waterline 140 of the ship 100. The size of the triangular pocket 8 is determined by calculating this vertical distance 142. The triangular pocket 8 is filled with air pumped into it through hoses 58 (FIG. 5) into air intake valves 10 located at the area closest to the bow of the ship 100. The air in the triangular pocket 8 is released by opening discharge valves 24 located in areas near the bow, mid-ships, and stern of the enclosure material 2.

When fully inflated and in place, the top of the triangular pocket 8 will conform to the natural V-shape of the hull 102 above the waterline 140 at the bow of the ship 100. This forms a barrier that prevents water outside the enclosure material 2 from entering the area between the enclosure material 2 and the hull 102 of the ship 100. A nonabrasive, nonabsorbent strip of material 12 is placed inside the top edge of the triangular pocket 8 to prevent frictional wear from the enclosure material 2 being in contact with the hull 102 of the ship 100. This nonabsorbent strip of material 12 will also serve as a gasket to prevent or inhibit rainwater and debris from entering the area between the enclosure material 2 and the hull 102.

In accordance with another embodiment of the invention, before initial deployment, a cargo rope 14 at either end of the enclosure material 2 is pulled through a series of steel rings 16 attached to a reinforced strip of material 18 that runs down the middle of the length of the enclosure material 2. The cargo rope 14 ends are attached to buoys 20 and tethered by way of tethers 22 to the side of the enclosure material 2. The tethers 22 are of sufficient length to allow the buoys 20 to ride on the surface of the water from the low water mark to the waterline 140.

Figure 2:
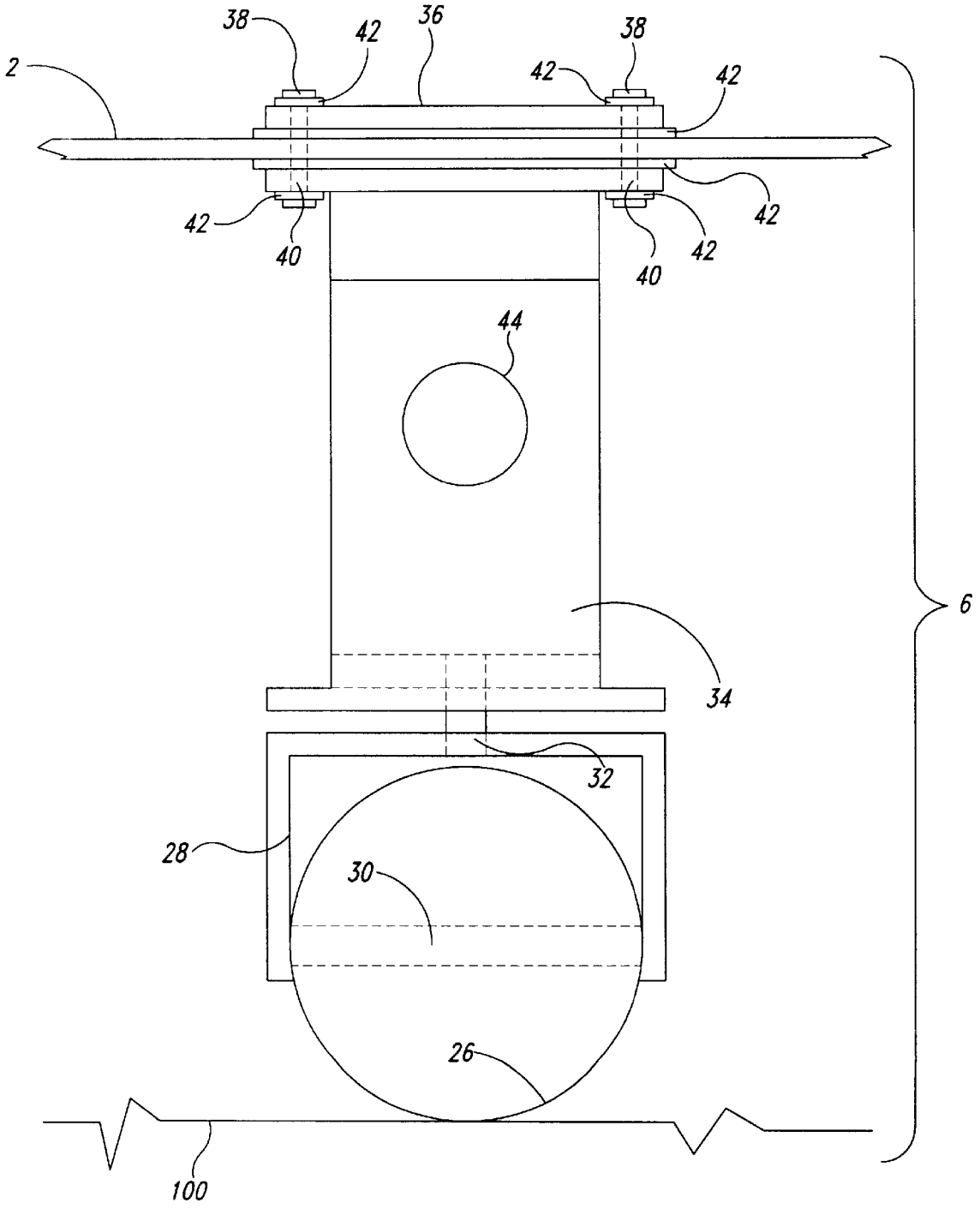
FIG. 2 is a schematic view of the caster device used to maintain uniform distance between the enclosure material and the hull of the ship.

FIG. 2 is a schematic view of the caster device used to maintain a uniform distance between the enclosure material 2 and the hull 102 of the ship 100. In accordance with yet another embodiment of the invention, the enclosure material 2 further includes separation devices 6 as best seen in FIG. 2. They may be attached by a plate 36, made of the same material as a body 34 of the device 6, to the outer and inner surfaces of the enclosure material 2 in a grid pattern.

In the exemplary embodiment the separation devices 6 use a nonabrasive, pliable ball 26 made of a material, such as urethane, as the caster. This is attached to a frame 28 by an axel or roller 30 made of the same material as the frame 28. The frame 28 is made out of ultra-high-molecular-weight (UHMW) plastic, aluminum or stainless steel, depending on the final location for the separation device 6. The roller 30 passes from one side of the frame 28, through the center of the ball 26 and reconnects to the other side of the frame 28.

A pin assembly 32 of the same material as the frame 28 allows the ball 26 and the frame 28 to rotate freely. The body 34 of the separation device 6 is also made of the same material as the frame 28, roller 30 and plate 36 (such as stainless steel or plastic).

The body 34 of the device is attached to the plate 36 on the outside of the enclosure material 2 by stainless steel nuts 38 and bolts 40. Gaskets 42 provide a watertight seal for the plate 36, body 34, nuts 38 and bolts 40. A hole 44, allows the transducer housing 52 (shown in FIG. 4) to attach to the body 34 of the separation device 6.

In this exemplary embodiment, the separation devices 6 are used to maintain a uniform distance of approximately six inches between the enclosure material 2 and the ship's hull 102. This insures that the enclosure material 2 doesn't adhere to the hull 102 of the ship 100 due to the influence of wave action or local tides and currents. Rubbing against the hull 102 of the ship 100 could result in damage to the coating of the ship 100 due to frictional wear. The maintenance of a uniform distance also provides an adequate amount of water for the effective use of cavitation.

The exact pattern and distance for placement of the separation devices 6 is dependent on the size and shape of the ship's hull 102. Optimally, those separation devices 6 made of connecting material would be placed at and above the low water mark of the hull 102 and the devices 6 made out of aluminum would be placed from the low water mark to a level even with the bottom of the hull 102. Those separation devices 6 made out of stainless steel would be placed opposite the bottom of the ship's hull 102 and would help act as ballast during the deployment and retrieval of the enclosure material 2.

Figure 3:
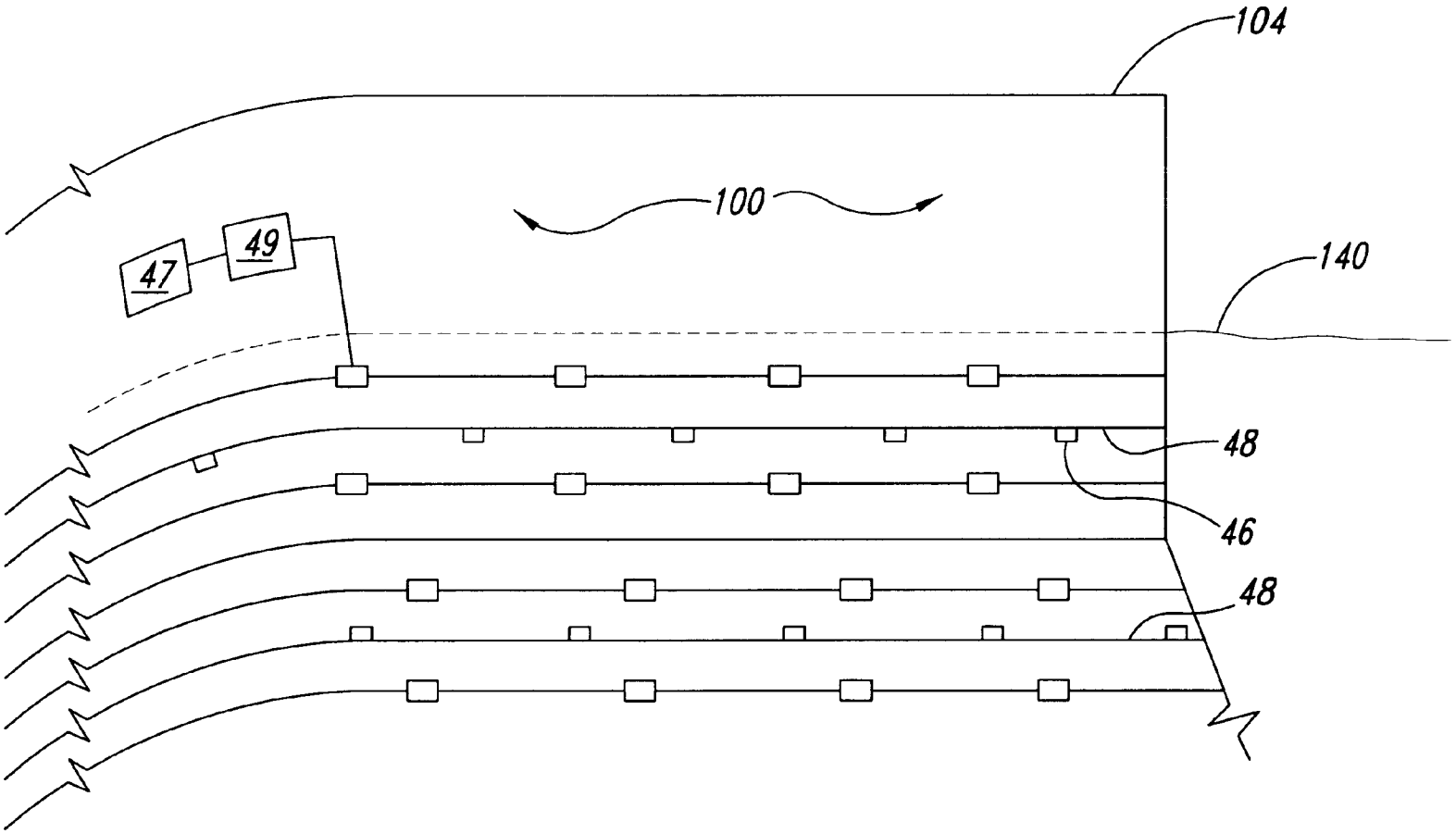
FIG. 3 is a schematic interior elevation view of one exemplary embodiment showing transducers mounted on circuit boards in a diamond-shaped grid pattern on the interior hull of a ship.

FIG. 3 is a schematic interior elevation view of one exemplary embodiment showing transducers 1 mounted on circuit boards in a diamond-shaped grid pattern on the interior hull 102 of a ship 100. In accordance with one embodiment of the invention, the ultrasonic transducers 1 are mounted in a grid pattern on circuit boards in interior housings 46 on the interior of the ship's hull 102. The exact pattern and distance between transducers 1 is dependent on the size and shape of the ship's hull 102. The frequency and pulse length of each ultrasonic transducer 1 could be adjusted to minimize the effect of structural damping. It is anticipated that the normal cleaning time for the system would be approximately 15–20 minutes depending on the size and type of ship 100.

In the exemplary embodiment, the transducers 1 produce ultrasonic pulsed signal sound waves in the frequency range of 20–65 kHz. The ultrasonic sound waves induce cavitation that, in turn, cleans the hull 102 of any marine organisms.

Electrical wiring enclosed in conduit 48 links the transducers 1 in parallel to a central control system 49. To ensure the safety of the crew and equipment inside the ship 100, sound proofing material encloses the circuit boards and radio frequency interference filters 47 are also used.

Figure 4:
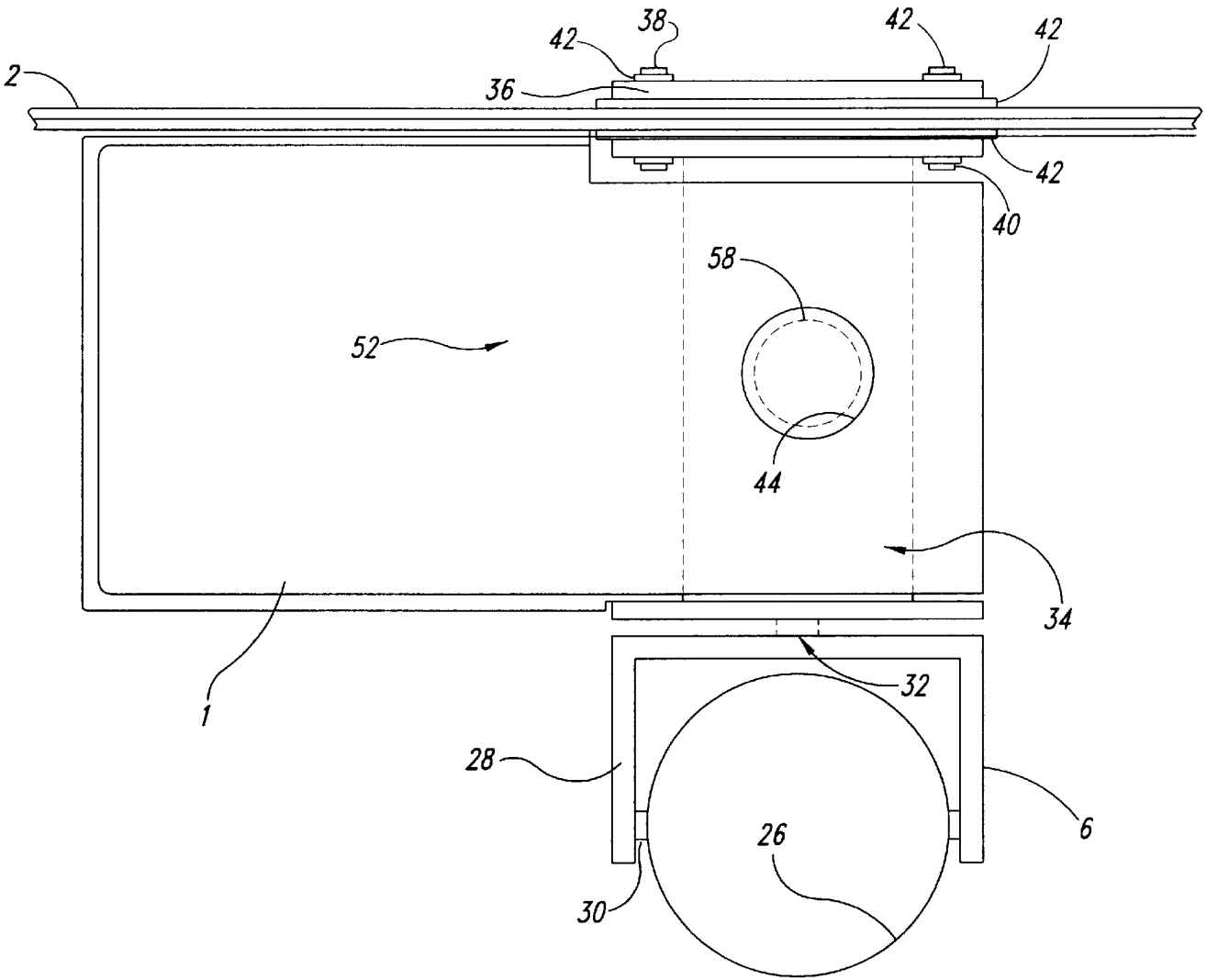
FIG. 4 is a side view of one exemplary embodiment illustrating a watertight housing containing a transducer attached to a separation device (shown in FIG. 2).

FIG. 4 is a side view of one exemplary embodiment illustrating a watertight housing containing a transducer 1 attached to a separation device 6. In accordance with yet another embodiment of the device, a stainless steel pin 50, threaded at one end, is placed through a sealed, watertight, housing 52 that fits around the body 34 of the separation device 6 (shown in FIG. 2). The housing 52 is made of UHMW plastic or similar material. The pin 50 is secured to the housing 52 and the separation device 6 by a stainless steel nut (not shown) applied at the threaded end of the pin 50.

In the exemplary embodiment, the housing 52 is partially surrounded by the same nonabrasive, pliable material used for the ball 26, as shown in FIG. 2. It is attached to the housing 52 to prevent any possible damage to the enclosure material 2 or the hull 102 of the ship 100. The transducers 1 located inside the housing 52 may be battery operated and activated by remote control radio frequency. The exact pattern and distance between transducers 1 is dependent on the size and shape of the ship's hull 102.

The above embodiment of the invention recognizes that retrofitting some ships 100 with transducers 1 might be inadvisable for a number of practical reasons. Therefore, this alternative embodiment affords the benefits of the invention without the necessity of placing transducers 1 inside the ship's hull 102.

Figure 5:
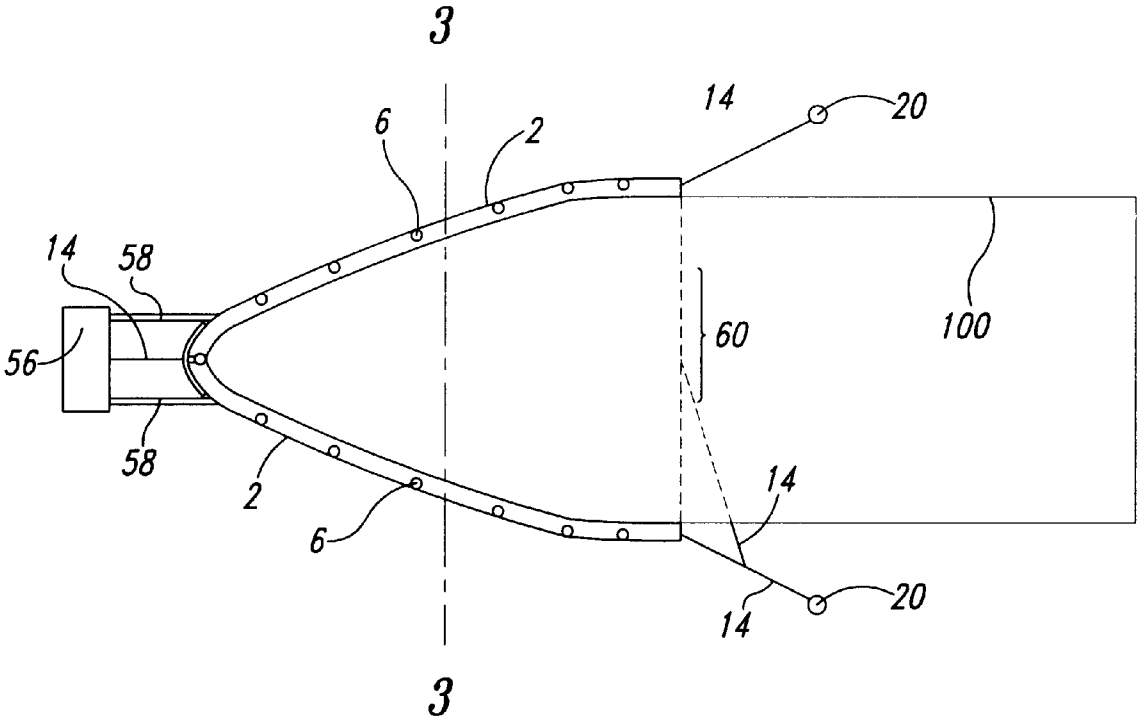
FIG. 5 is a schematic top plan view of one exemplary method of deploying the material around a ship from bow to stern.

FIG. 5 is a schematic plan view of one exemplary method of deploying the enclosure material 2 around a ship 100 from bow to stern. In accordance with this embodiment, a cargo rope 14 at the bow end of the enclosure material 2 can be secured to a dock or tug boat 56 where an air pump and the hoses 58 are also located. The enclosure material 2 has previously been rolled up (not shown) and transported to the area at the bow of the ship 100. Rolling prevents the absorbent lining material 4 from sticking to itself because of the distance provided by the separation devices 6. The rolled up enclosure material 2 may either be towed behind a tug boat or unrolled from a dock 56.

In the exemplary embodiment, as the triangular pocket 8 is filling with air, the rest of the enclosure material 2 is deployed through the pulling of cargo ropes 14 attached to the top corners of the enclosure material 2 that encloses the stern of the ship 100. These cargo ropes 14 are pulled clear of the enclosure material 2 as it is rolled up for deployment.

The top edge of the enclosure material 2 (located toward the stern of the ship 100) is gathered and stitched onto an elastic material 60 so that it will stretch over the ship's propellers. It is pulled over the propellers by the cargo rope 14 that is attached at the mid-point of the top of the elastic material 60. The other end of this cargo rope 14 is hooked onto one of the other cargo ropes 14 which is used to deploy the enclosure material 2 when the enclosure material 2 is initially rolled up. The ends of the cargo ropes 14 used to deploy the enclosure material 2 are secured by buoys 20 that are tethered by way of tethers 22 to the enclosure material 2 when not in use.

Once the enclosure material 2 is fully deployed, the transducers 1 are activated, and the ship 100 is cleaned. The transducers 1 may be reactivated at lower pulse rates whenever necessary to reduce fouling on the enclosure material 2 itself. The enclosure material 2 remains in place until the ship 100 is ready to leave port.

Figure 6:
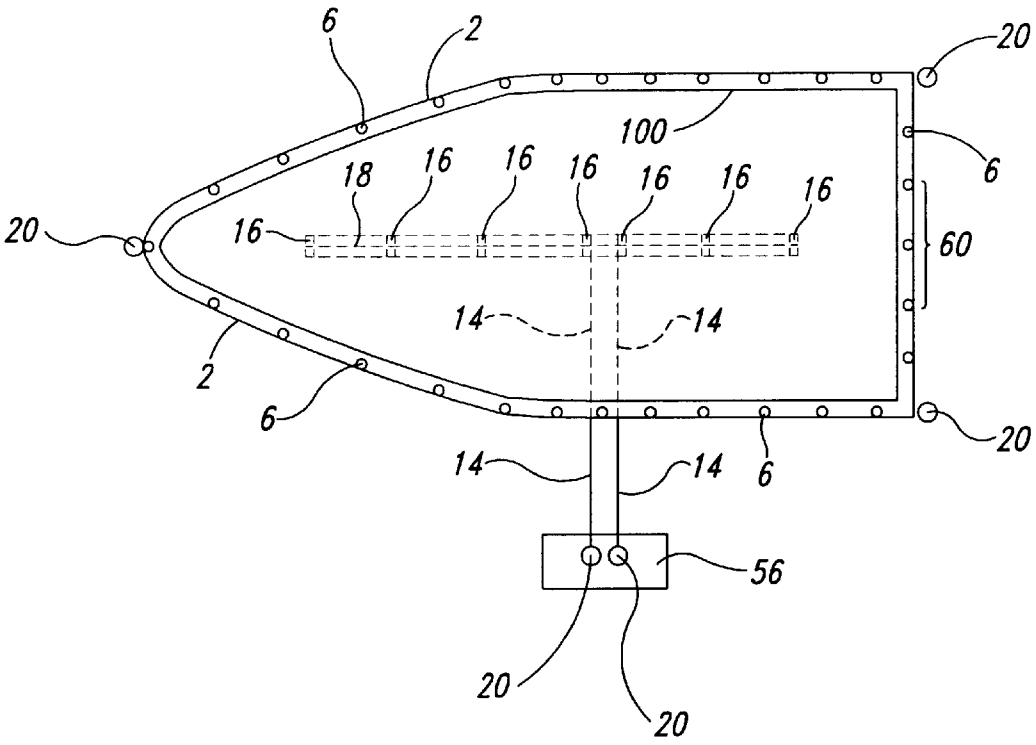
FIG. 6 is a schematic top plan view of one exemplary method of removing the enclosure material by collecting the material from the side of the ship using cargo ropes and winches.

FIG. 6 is a schematic plan view of one exemplary method of removing the enclosure material 2 by collecting the enclosure material 2 from the side of the ship 100 using cargo ropes 14 and winches. In accordance with this embodiment, the enclosure material 2 is removed by again using cargo ropes 14 attached to buoys 20. The cargo ropes 14 have been pulled through steel rings 16 on the underside of the enclosure material 2 prior to deployment, as shown in FIG. 1. At the mid-point, the two cargo ropes 14 are brought through a ring 16 and pulled outside the enclosure material 2 as it is rolled up for deployment. Each cargo rope 14 is attached to a buoy 20 at that time. The cargo ropes 14 and buoys 20 are tethered by way of tethers 22 to the enclosure material 2 after deployment, as shown in FIG. 1.

In the exemplary embodiment, when the ship 100 is ready to leave port, the buoys 20 are picked up and removed. The ends of the cargo ropes 14 are then attached to winches located on a dock or tug boat 56 located at mid-ships. As the discharge valves 24 shown in FIG. 1 are opened, air escapes and the triangular pocket 8 collapses. The enclosure material 2 is winched onto the dock or to a position just aft of a tug boat 56. The enclosure material 2 collapses in on itself, much like picking up a handkerchief at its midpoint. This natural action, along with the slight tackiness of the absorbent lining material 4, effectively traps any organisms or materials that have been fallen on to it due to the results of cavitation.

The absorbent lining material 4 can then be towed behind the tug 56 into a shipyard or onto a dock. The enclosure material 2 can then be unfolded, inspected, cleaned, repaired if necessary and refitted. The absorbent lining material 4 is removed and safely disposed of resulting in minimal environmental impact.

Figure 7:
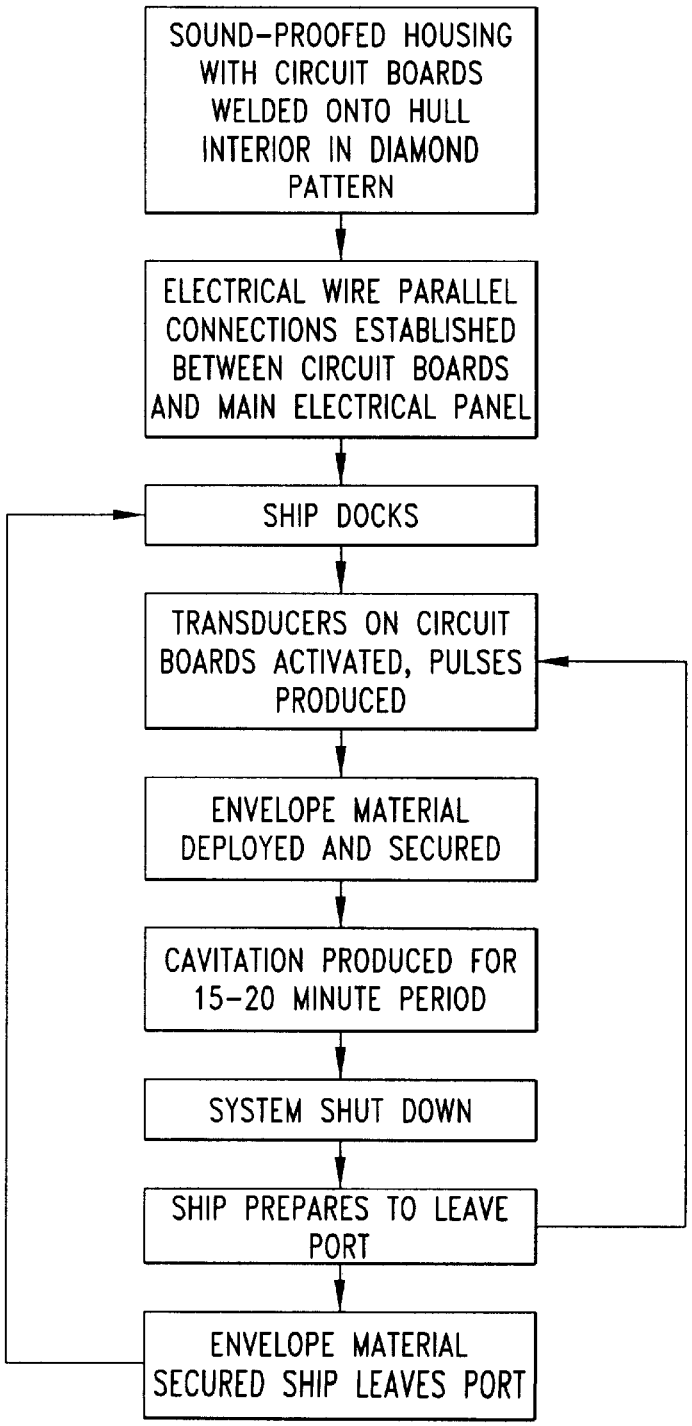
FIG. 7 is a flow diagram of sequencing steps that summarizes a method of ultrasonic cleaning of the foulant.

FIG. 7 is a flow diagram of sequencing steps that summarizes a method of ultrasonic cleaning of the foulant. FIG. 7 is self explanatory based on the detailed description provided herein.

Figure 8:
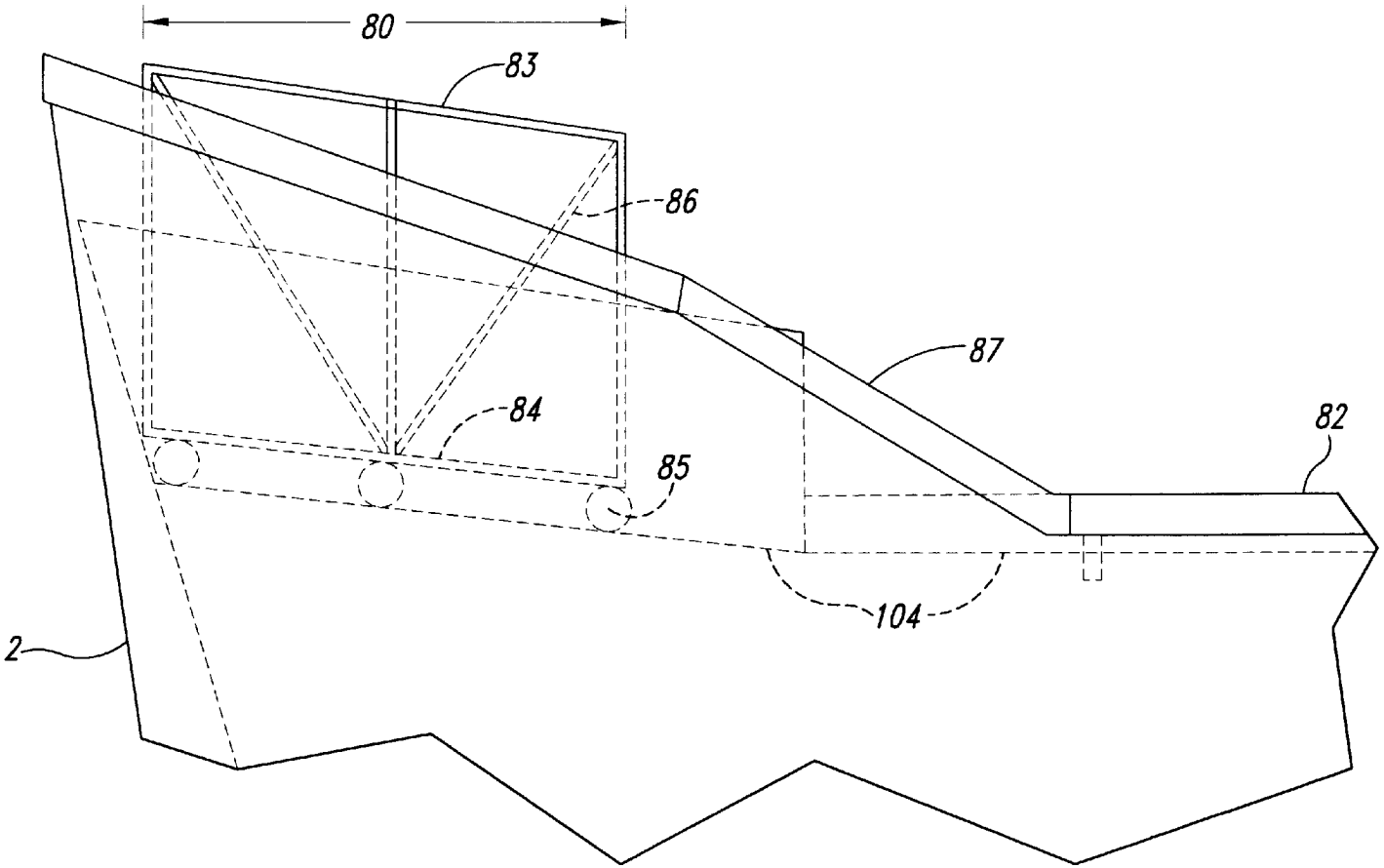
FIG. 8 is a schematic side elevation view of a track and a storage cart for an enclosure deployment system.
Figure 9:
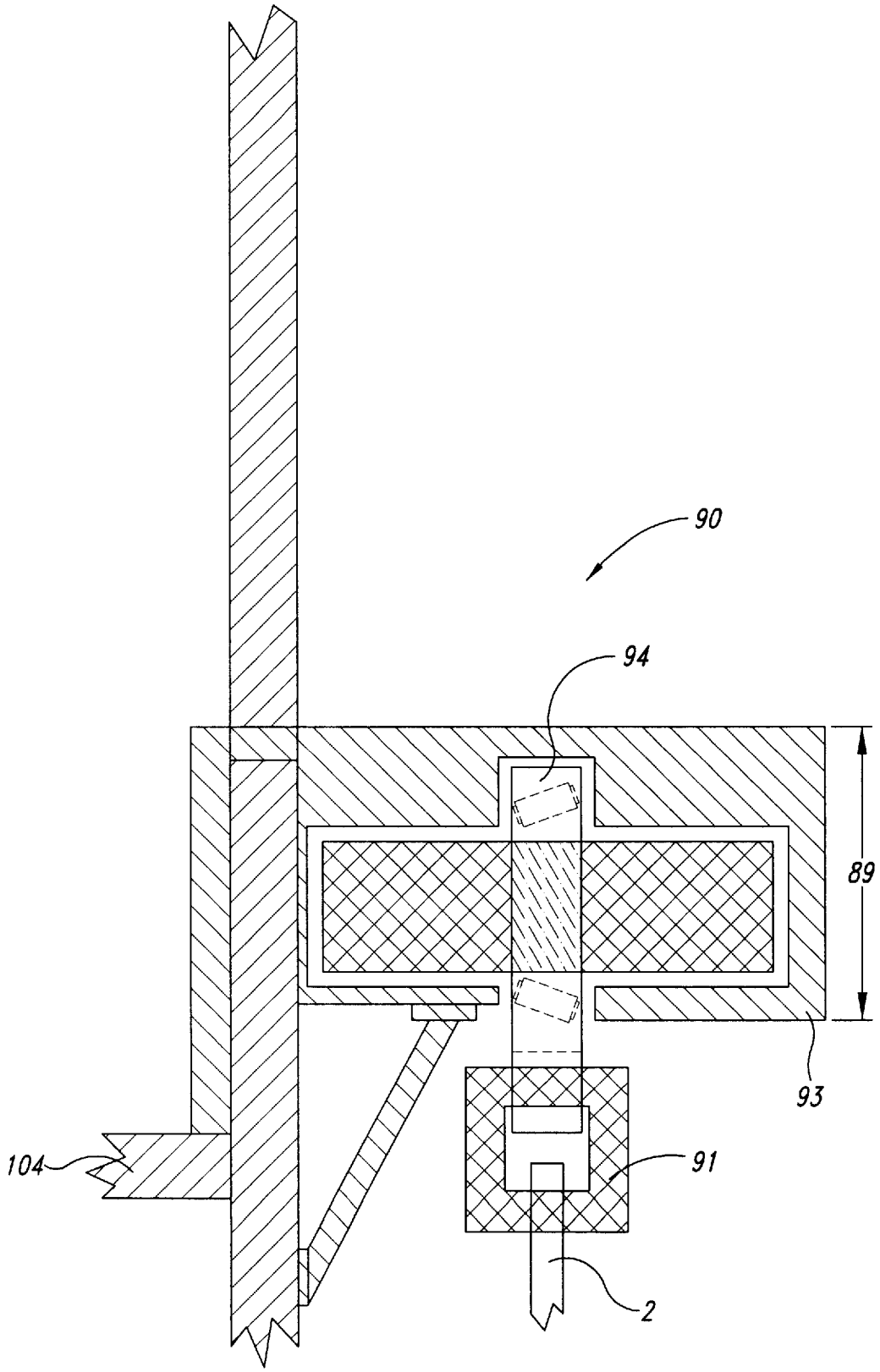
FIG. 9 is a schematic cross-section view of the roller assembly for the enclosure deployment system.
Figure 10:
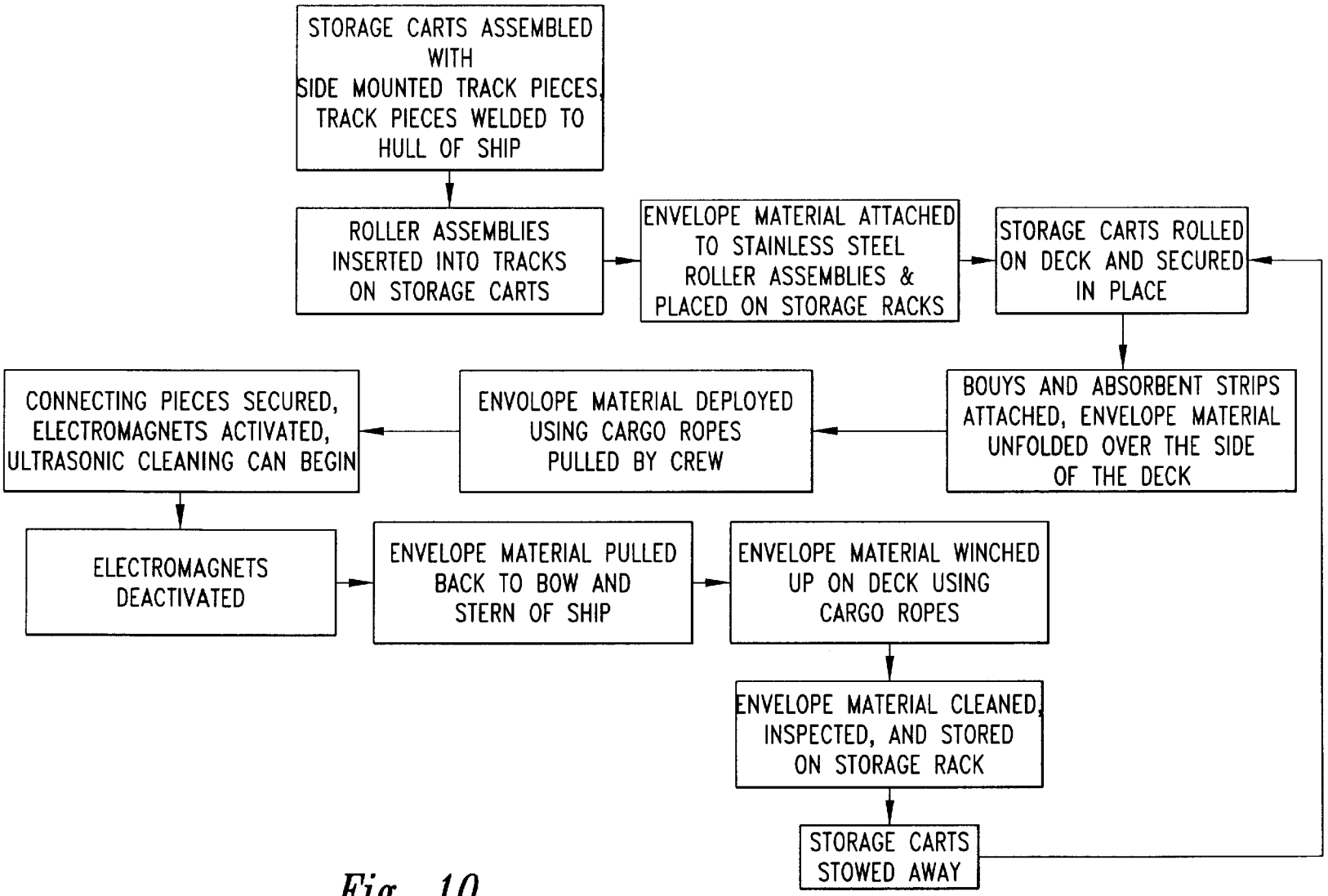
FIG. 10 is a flow diagram of sequencing steps that summarizes the method of deployment of the end enclosure material using the track system.

FIG. 8 is a schematic elevation view of the track 82 and the storage cart 80 for an enclosure deployment system. The storage cart 80 can be made up of aluminum trusses 86 that form a frame 28 attached to a top platform 83 and a bottom platform 84. FIG. 9 is a schematic cross sectional view of the roller assembly 90 for the same enclosure deployment system. FIG. 10 is a flow diagram of sequencing steps that summarizes a method of deployment of the enclosure material 2 using the track system. FIG. 10 is self explanatory based on the detailed description provided herein.

In accordance with yet another embodiment of this invention, the enclosure material 2 can be deployed from the deck 104 of the ship 100, and can be stored on the ship 100. In accordance with this embodiment, a storage cart 80 holds the roller assemblies 90 inside the permanently attached lengths of track 82 when the enclosure material 2 is not in use. This is analogous to a shower curtain on a shower rod when the curtain is pushed as far to the side as possible. The enclosure material 2 can be folded accordion style up and over the storage cart 80 when not in use. The roller assemblies 90 are still inside the permanently attached lengths of track 82 while the enclosure material 2 is stored in this way. This most closely resembles a shower curtain as described above that has been folded up and over the curtain rod.

The storage cart 80 is moved into position on the deck 104 for deployment and secured. The connecting track section 87 on the storage cart 80 is attached to the permanently attached track 82. The enclosure material 2 is attached to the roller assemblies 90 by support rings 91 that pass through an outer support housing 93 that holds the bearing housing 94 (shown in FIG. 9). The support rings 91 fit through the stainless steel grommets (not shown) on the top edge of the enclosure material 2. The enclosure material 2 can be unfolded and the roller assemblies 90 roll out from the connecting track section 87 on the storage cart 80, and through the permanently attached track 82. This is analogous to pulling a shower curtain across the curtain rod until it is fully deployed.

Figure 11A:
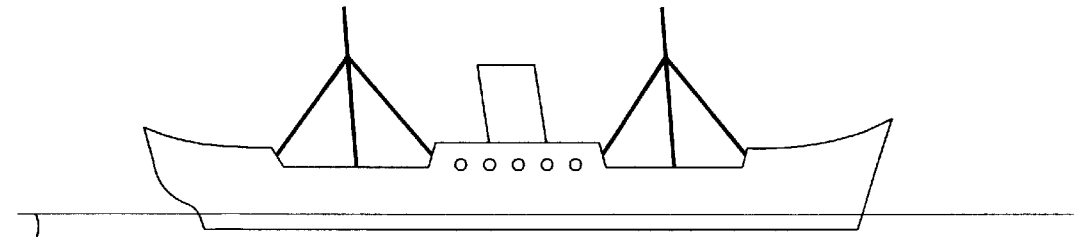
FIGS. 11*a*, 11*b* 11*c* are schematic views of a two piece enclosure material deployment in sequence.
Figure 11B:
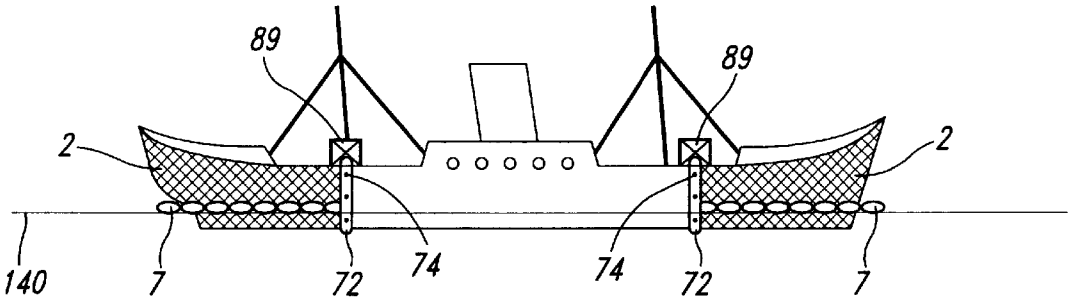
Figure 11C:
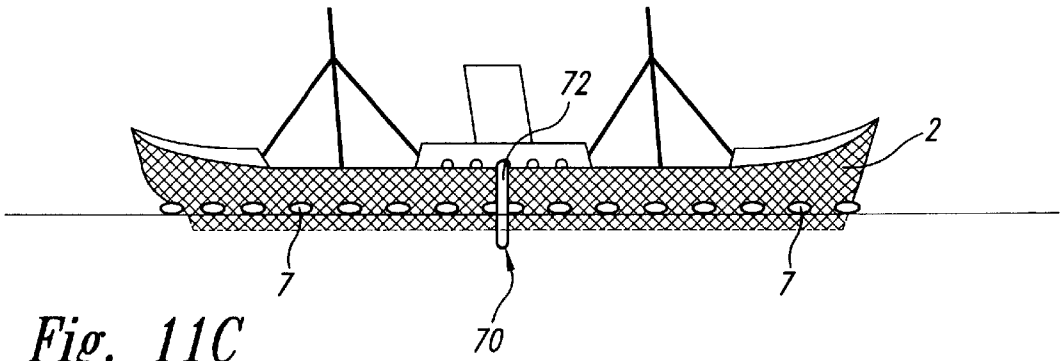
Figure 12:
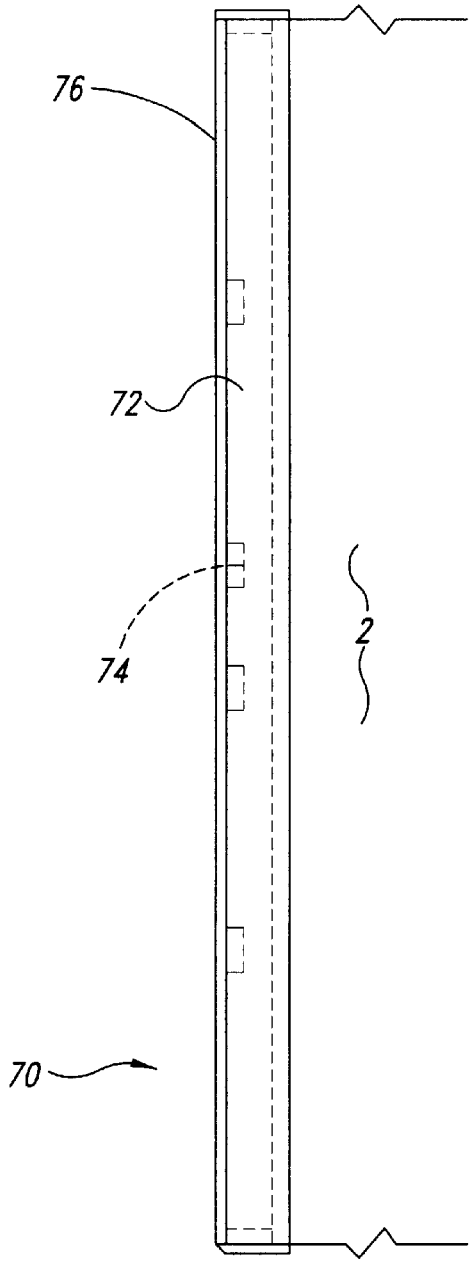
FIG. 12 is a schematic side elevation view of the mid-ship connecting piece for the enclosure material.

FIGS. 11*a*, 11*b*, and 11*c* are schematic views of a two piece enclosure material 2 showing deployment sequence. FIG. 12 is a schematic side elevation view of the mid-ship connecting piece for the enclosure. In accordance with yet another embodiment of the invention, if the enclosure material 2 is deployed in two pieces, this connecting link 70 can be employed in order to keep the connection watertight. The connection link 70 incorporates a strip of UHMW (ultra-high-molecular weight) connecting material 72, or other appropriately strong and chemical resistant materials, in sections that run along the leading edge of the enclosure material 2 sections. The leading edge of the enclosure material 2 is affixed in a slot in the connecting material 72 and sealed with caulking at the edges. At evenly spaced intervals along the perimeter of the connecting material 72, an electromagnet 74 is inserted. On the outside edges of the connecting link 70, a rubber gasket 76 is securely affixed. Upon deployment of the two pieces of enclosure material 2, the two pieces of enclosure material 2 are clamped together at the deck 104 level for several feet down the connecting material 2 in the direction of the bottom of the hull 102, and an electrical current is then sent down the connecting material 72 to draw the electromagnets 74 together. Because the connecting material 72 is joined at the top, the electromagnets 74 will already be engaged at that point and the magnetic attraction will pull the two halves together much like the seal on a plastic bag functions. In an alternative embodiment, an electronic signal can be sent back to a small control pad at the deck 104 level to indicate that the seal was complete in the connection link 70.

FIG. 13 is sample engineering calculations provided for reference. The power supplied to the system described above is assumed to be supplied by the ship 100 if at anchor away from a docking facility, or supplied at dock side if the ship 100 is in port. FIG. 13 is self explanatory based on the detailed description provided herein.

The particular embodiments of the enclosure material 2 and the transducers 1 described above are expected to remove and control foulant organisms on the hull 102 of a ship 100 at rest.

From the foregoing, it will be appreciated that, although specific embodiments of the invention have been described herein for purposes of illustration, various modifications may be made without deviating from the spirit and scope of the invention. For example, some combination of interiorly mounted transducers 1 may be used with transducers 1 mounted on separation devices 6. Accordingly, the invention is not limited except by the appended claims.

Aspects of the present invention can be applied to not only large ships, but also to other structures. For example, in an alternative embodiment, the present invention can be used on a smaller ship or structure.

All of the above U.S. patents and applications are incorporated by reference. While the present invention is for a foulant control system such as for use with for large ships, the present invention can similarly be used in other applications and on smaller ships.

These and other changes can be made to the invention in light of the above detailed description. In general, in the following claims, the terms used should not be construed to limit the invention to the specific embodiments disclosed in the specification and the claims, but should be construed to include all foulant control systems that operate under the claims to provide a method for removing and controlling foulant. Accordingly, the invention is not limited by the disclosure, but instead its scope is to be determined entirely by the following claims.

What is claimed is:

1. An apparatus for removing and preventing foulant accumulation below the waterline of a hull of a vessel comprising:

an enclosure having an interior side and an exterior side, the enclosure being slightly larger than, and substantially conforming to the shape of, the hull, and the interior side being placed in close proximity to the hull; and a plurality of transducers producing an ultrasonic signal, the transducers positioned to transmit the ultrasonic signal into the water between the hull and the enclosure.

2. The apparatus of claim 1, further comprising a plurality of spacers extending between the enclosure and the hull to maintain a selected distance between the enclosure and the hull.

3. The apparatus of claim 1, further comprising a plurality of spacers interposed between the enclosure and the hull to maintain a selected distance between the interior side of the enclosure and the hull, the spacers comprising casters attached to the enclosure and in rolling engagement with the hull.

4. The apparatus of claim 1 wherein the transducers produce pulsed ultrasonic signals in the frequency range between about 20 kHz and about 65 kHz.

5. The apparatus of claim 1 wherein the transducers are mounted to the interior of the hull.

6. The apparatus of claim 1 wherein the transducers are mounted to the interior of the hull, the transducers being spaced in a diamond pattern along the length of the ship.

7. The apparatus of claim 1 further comprising a plurality of spacers interposed between the enclosure and the hull to maintain a selected distance between the enclosure and the hull, the transducers being mounted to the spacers.

8. The apparatus of claim 1 wherein the enclosure is made of a lightweight, pliable, waterproof material.

9. The apparatus of claim 1 wherein the enclosure has inflatable chambers above the waterline of the vessel.

10. The apparatus of claim 1 further comprising a substantially tacky liner removably attached to the interior side of the enclosure below the waterline of the vessel.

11. The apparatus of claim 1 further comprising a reflective coating applied to the interior side of the enclosure, the reflective coating extending along the entire length of the enclosure and extending from above the waterline to the keel.

12. The apparatus of claim 1 further comprising a seal attached to the enclosure and positioned on the hull near the gunwales of the vessel to prevent rainwater and debris from entering the space between the enclosure and the hull.

13. The apparatus of claim 1 further comprising a control system operatively connected to the transducers.

14. The apparatus of claim 1 further comprising a control system operatively connected to the transducers and radio frequency filters connected thereto.

15. An apparatus for removing and controlling foulant accumulation below the waterline of a hull of a vessel comprising:

an enclosure having an interior side closest to the hull and an exterior side farthest from the hull, the enclosure approximately conforming to the shape of the hull, being positioned proximate to the hull, extending the entire length of the vessel, and extending between the keel and the gunwales of the vessel;

a plurality of spacers interposed between the enclosure and the hull to maintain a selected distance between the enclosure and the hull; and a plurality of transducers positioned to transmit an ultrasonic signal produced by the transducers and induce cavitation in the water trapped between the enclosure and the hull below the waterline of the vessel.

16. The apparatus of claim 15 further comprising a control system operatively connected to the transducers.

17. The apparatus of claim 15 wherein the spacers comprise casters attached to the enclosure and in rolling engagement with the hull.

18. The apparatus of claim 15 wherein the transducers produce pulsed ultrasonic signals in the frequency range between about 20 kHz and about 65 kHz.

19. The apparatus of claim 15 wherein the transducers are mounted to the interior of the hull.

20. The apparatus of claim 15 wherein the transducers are mounted to the interior of the hull, the transducers being spaced in a diamond patterns along the length of the ship.

21. The apparatus of claim 15 wherein the transducers are mounted to the spacers.

22. The apparatus of claim 15 wherein the enclosure is made of a lightweight, pliable waterproof tarp-like material.

23. The apparatus of claim 15 wherein the enclosure has inflatable chambers above the waterline of the vessel to keep the enclosure near the hull.

24. The apparatus of claim 15 further comprising a substantially tacky liner removably attached to the interior side of the enclosure below the waterline of the vessel.

25. The apparatus of claim 15 further comprising a seal attached to the enclosure and positioned along the hull near the gunwales of the vessel to prevent rainwater and debris from entering the space between the enclosure and the hull.

26. The apparatus of claim 15 further comprising a reflective coating applied to the interior side of the enclosure, the reflective coating extending along the entire length of the enclosure and extending from a selected distance above the waterline to the keel.

27. A method of removing foulant from the hull of a vessel comprising:

surrounding the hull with a enclosure; and transmitting ultrasonic signals produced by transducers into the water between the enclosure and the hull.

28. The method of claim 27 wherein transmitting ultrasonic signals into the water between the hull and the enclosure induces cavitation.

29. The method of claim 27 further comprising maintaining a selected separation between the enclosure and the hull.

30. A method of removing and preventing foulant accumulation below a waterline of a hull of a vessel comprising:

positioning a waterproof enclosure to surround the hull;

transmitting ultrasonic signals produced by transducers into the water between the enclosure and the hull for a selected amount of time until the foulant is removed from the hull; and removing the waterproof enclosure from its position surrounding the hull.

31. The method of claim 30 wherein positioning the waterproof enclosure comprises:

pulling the enclosure along the length of the vessel using cargo ropes attached to the enclosure along the portion of the enclosure that lies near to the keel when the enclosure is in its operational position;

attaching cargo ropes to buoys;

securing the enclosure at a bow and a stem of the vessel; and inflating chambers located in the enclosure above the waterline to maintain the enclosure in its position surrounding the hull.

32. The method of claim 30 wherein removing the waterproof enclosure comprises:

attaching cargo ropes to a winch;

deflating chambers located in the enclosure above the waterline; and winching the enclosure material away from the hull.

33. The method of claim 32 wherein removing the waterproof enclosure further comprises removing any attached buoys.

34. A method of removing and preventing foulant accumulation below the waterline of a vessel comprising:

deployment of at least two enclosure pieces around a hull of the vessel, each enclosure piece containing electromagnets spaced along a leading edge of the enclosure in a connecting material;

sealing the enclosure at the leading edge of the enclosure sections containing the connecting material;

inducing cavitation in the water between the enclosure and the hull; and removing the enclosure.

35. The method of claim 34 wherein sealing the enclosure at a meeting point of enclosure sections further comprises:

joining the enclosure pieces together at a point above the waterline;

running an electric current through the connecting material;

drawing the electromagnets together;

forming a watertight seal.

36. A vessel comprising a hull, an enclosure material slightly larger than the hull of the vessel and substantially conforming to the shape of the hull of the vessel, a plurality of transducers positioned to transmit ultrasonic signals produced by the transducers into the water between the hull and the enclosure to induce cavitation whereas the cavitation removes the foulant accumulation below the waterline of the hull.

37. The vessel of claim 36 further comprising a plurality of spacers extending between the enclosure and the hull to maintain a selected distance between the enclosure and the hull.

38. The vessel of claim 36 wherein the transducers produce pulsed ultrasonic signals in the frequency range between about 20 kHz and 65 kHz.

39. The vessel of claim 36 wherein the transducers are mounted to the interior of the hull.

40. The vessel of claim 36 further comprising a plurality of spacers interposed between the enclosure and the hull to maintain a selected distance between the enclosure and the hull, the transducers being mounted to the spacers.

41. The vessel of claim 36 wherein the enclosure has inflatable chambers above the waterline.

42. The vessel of claim 36 further comprising a substantially tacky liner removably attached to the interior side of the enclosure below the waterline.

43. The vessel of claim 36 further comprising a reflective coating applied to the interior side of the enclosure, the reflective coating extending along the entire length of the enclosure and extending from above the waterline to the keel.

44. The vessel of claim 36 further comprising a seal attached to the enclosure and positioned on the hull at the top of the enclosure.

45. The vessel of claim 36 further comprising a control system operatively connected to the transducers.

46. The vessel of claim 36 further comprising a permanent track system for transporting a storage cart; the storage cart comprising trusses, a roller assembly, a top panel and a bottom panel; the enclosure material stored on the bottom panel of the storage cart when not in use, the roller assembly integral to the top panel of the storage cart assembly comprising an outer support housing holding a bearing housing containing a roller, and a support ring; the support ring of the roller assembly interlocks a steel grommet in a leading edge of the enclosure material to deploy the enclosure material via the roller.

* * * * *

UNITED STATES PATENT AND TRADEMARK OFFICE

CERTIFICATE OF CORRECTION

PATENT NO. : 6,276,292 B1
DATED : August 21, 2001
INVENTOR(S) : Alice B. Soulek

It is certified that error appears in the above-identified patent and that said Letters Patent is hereby corrected as shown below:

Column 11,
Line 20, “a stem of the vessel;” should be corrected to read -- a stern of the vessel; --.

Column 12,
Line 8, “induce cavitation whereas” should be corrected to read -- induce cavitation, whereas --.

Signed and Sealed this

Sixth Day of August, 2002

*Attest:*

*Attesting Officer*

JAMES E. ROGAN
*Director of the United States Patent and Trademark Office*